United States Patent [19]

Pipa et al.

[11] Patent Number: 4,550,679

[45] Date of Patent: Nov. 5, 1985

[54] DEVICE FOR PRODUCING DECORATIVE PATTERNS ON CLOTHING

[75] Inventors: William Pipa, New Hyde Park; Robert F. Warren, Brooklyn; Harvey Russack, Chappaqua, all of N.Y.

[73] Assignee: Harvey Russack, Chappaqua, N.Y.

[21] Appl. No.: 619,543

[22] Filed: Jun. 11, 1984

[51] Int. Cl.[4] ..... B05B 13/02; B05C 11/08

[52] U.S. Cl. ..... 118/52; 118/320; 118/326; 427/240

[58] Field of Search ..... 118/326, 320, 52; 427/240

[56] References Cited

U.S. PATENT DOCUMENTS

| | | | |
|---|---|---|---|
| 3,280,792 | 10/1966 | Heyde | 118/52 |
| 3,636,492 | 1/1972 | Yamashita et al. | 118/320 |
| 3,942,420 | 3/1976 | Marino | 118/326 |
| 4,393,807 | 7/1983 | Fujimura et al. | 118/52 |

*Primary Examiner*—Shrive P. Beck

*Attorney, Agent, or Firm*—Amster, Rothstein & Engelberg

[57] ABSTRACT

A device for producing decorative patterns on clothing includes a variable speed motor connected to a clothing carrier which is adapted to hold and rotate clothing in response to activation of the motor within a covered housing equipped with self-closing ports through which paint can be applied to the rotating clothing while the operator is protected from paint being inadvertently thrown off of the rotating clothing.

2 Claims, 9 Drawing Figures

DEVICE FOR PRODUCING DECORATIVE PATTERNS ON CLOTHING

The present invention generally relates to a device for producing decorative patterns on clothing by a method commonly referred to as splash painting.

The art of splash painting on paper is well-known. Such devices for spinning pieces of paper to make splash art drawings, are disclosed, for example, in U.S. Pat. No. 2,557,348, U.S. Pat. No. 3,280,792, U.S. Pat. No. 3,323,491 and U.S. Pat. No. 3,373,717. However, with the increasing popularity of individualized clothing, there is a developing market for shirts and other clothing made by the splash art technique. One of the important desired features of splash art clothes is that purchasers can make the designs themselves in a short period of time on equipment located, for example, in a retail clothing establishment. In order to make splash art clothes commerically feasible, a device is required that can be easily installed in a commerical establishment, is easy to operate by a novice, will support clothing in a flat position, keeping paint from bleeding through to the back side of the clothing and will protect the operator from being splashed by paint inadvertently spun off the clothing during the painting process.

Accordingly, it is a general object of the present invention to provide a device for producing decorative patterns on clothing.

It is specific object of the present invention to provide a device for producing decorative patterns on clothing that can be easily operated by a novice and which includes means for securing clothing during the painting process.

It is a more specific object of the present invention to provide stretcher means, whereby a piece of clothing is positioned on stretcher means so that paint does not bleed through to the back of the garment during the painting process.

It is a further and more specific object of the present invention to provide removable stretcher means, whereby a freshly painted garment can be removed from the device and placed into a drying oven without removing the garment from the stretcher means.

It is a further object of the present invention to provide a device for producing decorative patterns on clothing that includes a fully enclosed cover equipped with self closing ports so that an operator is protected during the decoration process from paint that is centrifugally spun off of a garment.

In accordance with the present invention, a device for producing decorative patterns on clothing is disclosed which comprises a housing, a motor mounted to the housing, carrier means driven by the motor adapted to removably mount clothing within the housing, a cover attached to the housing and equipped with at least one port to permit paint to be dispensed onto the mounted clothing and activation means electrically connected with the motor to cause the carrier means to rotate to create decorative patterns on clothing.

In a specific embodiment of the present invention, directed to a device for decorating shirts, a variable speed motor is enclosed in a housing and coupled to rotate an adjustable stretcher carrier in the horizontal plane. Various lengths of stretchers are provided (depending on the size of the shirt to be painted) for mounting into the adjustable stretcher carrier. A transparent cover, such as a dome, fits over the motor housing and fully encloses the stretcher carrier. A plurality of ports are provided in the transparent dome so that containers holding decorative paints can be inserted through the ports to apply paints to the surface of the shirt, either when the shirt is stationary or when it is rotating. By varying the speed of the motor and the time at which the paint is applied to the shirt (during rotation of the shirt or when the shirt is stationary), the type of design capable of being produced on the shirt can be varied. A further feature of the preferred embodiment of the invention is a disposable splash liner, removably mounted inside the transparent cover, to catch excess paint which is centrifugally thrown off shirts during the painting process to prevent the build up of paint on the device. The liner can be periodically discarded to clean the device. The inlet ports provided in the transparent dome are formed with pliable plastic closures so that when a paint container is not inserted into a port, the port automatically closes to protect the operator from paint inadvertently thrown off of a garment.

These and other objects of the invention will become more apparent to a worker skilled in the art upon reading the following detailed description taken in conjunction with the following drawings, of which:

Figure 2:
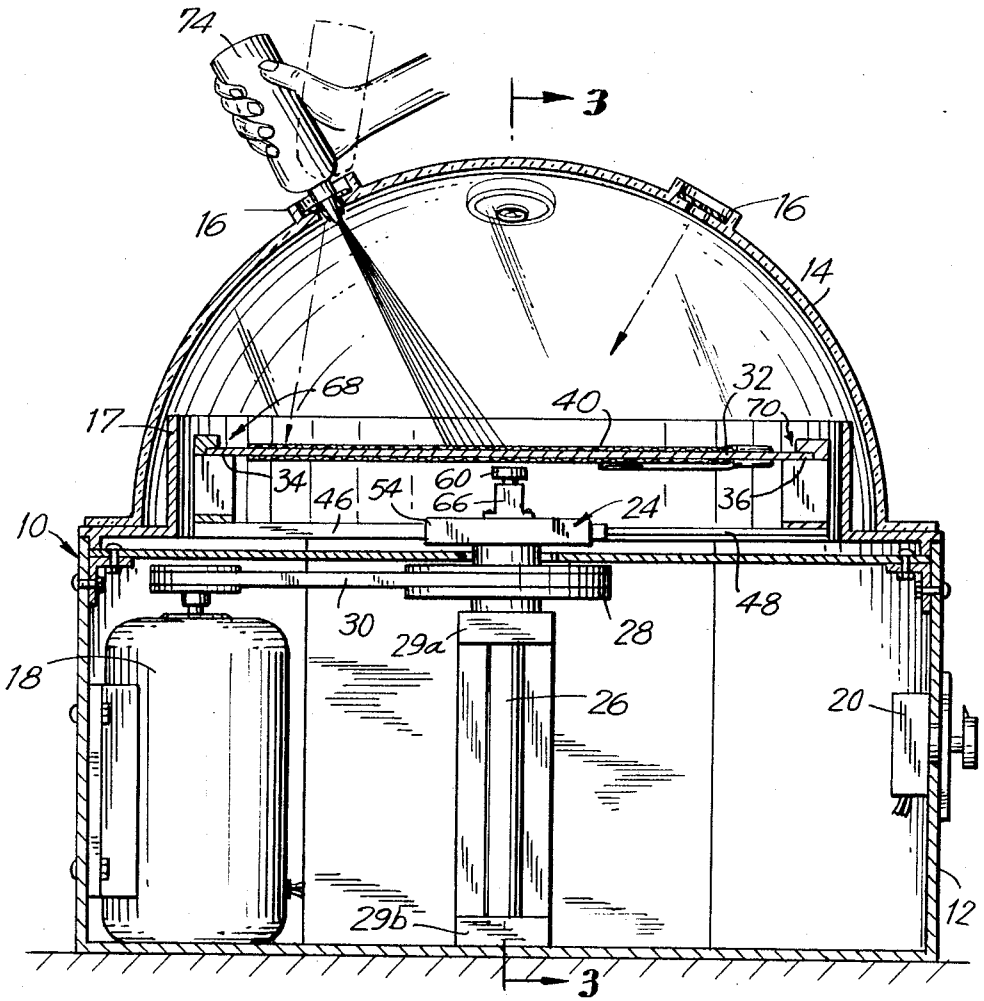
FIG. 2 is a sectional view of the splash art device taken along the line 2—2 of FIG. 1, showing the motor connected to the rotating stretcher carrier, in which a stretcher is mounted, fitted with a shirt about to be painted.
Figure 1:
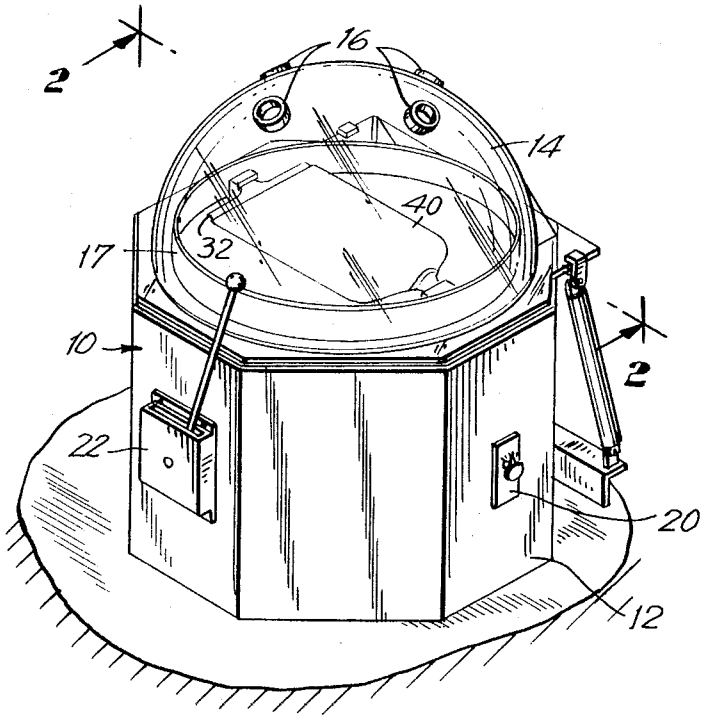
FIG. 1 is an external view of the device for producing splash art clothing showing a shirt installed on a stretcher, which is mounted in a stretcher carrier.

Referring now to FIGS. 1–5, the device for producing decorative patterns on clothing 10, includes housing 12, formed for example, out of vacuum formed plastic, transparent cover 14, similar to the type disclosed in U.S. Pat. No. 4,393,807, formed with ports 16 to allow paint to be applied to a shirt during the operation of device 10 and disposable splash liner 17 to keep paint from building up on cover 14. Device 10 further includes motor 18, for example, a standard single phase 120 volt AC motor, timer 20, for example, a conventional power timer and motor control lever 22 attached, for example, to conventional motor speed controller 23. Stretcher carrier means 24 for holding a shirt or other clothing to which paint is applied, is mounted on shaft 26. Also mounted on shaft 26 is pulley 28 which coupled to motor 18 by drive belt 30. Shaft 26 is supported by and freely rotates in bearings which are mounted at opposite ends 29(*a*) and 29(*b*) of shaft bracket 29. The rotation of motor 18 will cause stretcher carrier means 24 to rotate in a horizontal plane. Stretcher carrier means 24 supports stretcher means 32 having end tabs 34 and 36 onto which a shirt 40 or another garment has been placed by slipping stretcher means 32 between the front and rear surfaces thereof to maintain the garment in a stretched position during decoration and prevent paint bleed through to the back of the garment. To hold shirt 40 tightly onto stretcher means 32, sleeves 42 are taped to the rear of shirt 40 by tape 44. The length of stretcher means 32 is governed by the size of the clothing to be decorated by device 10.

Figure 4:
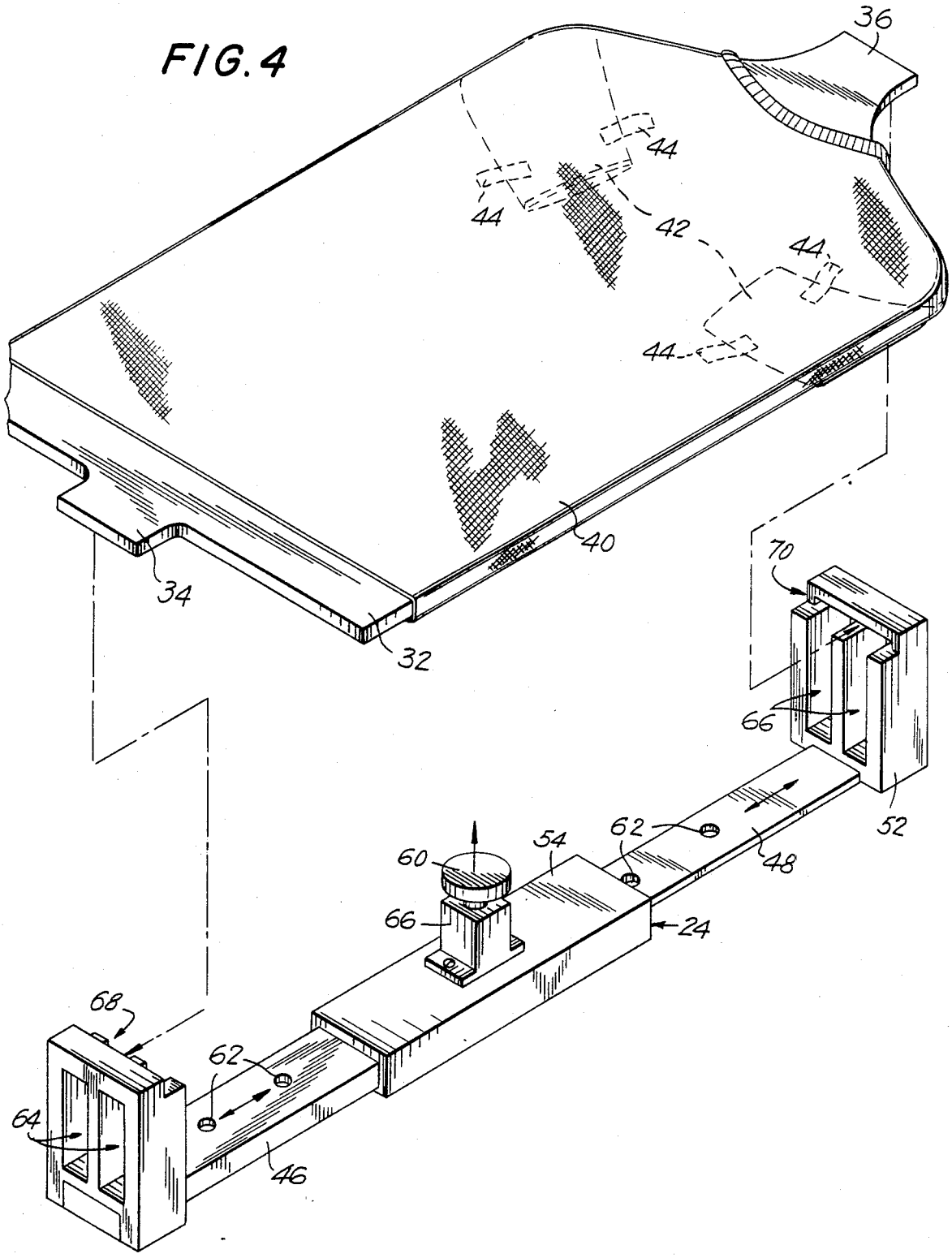
FIG. 4 is a view of a specific embodiment of a stretcher, fitted with a shirt and being installed into a specific embodiment of a stretcher carrier.
Figure 5:
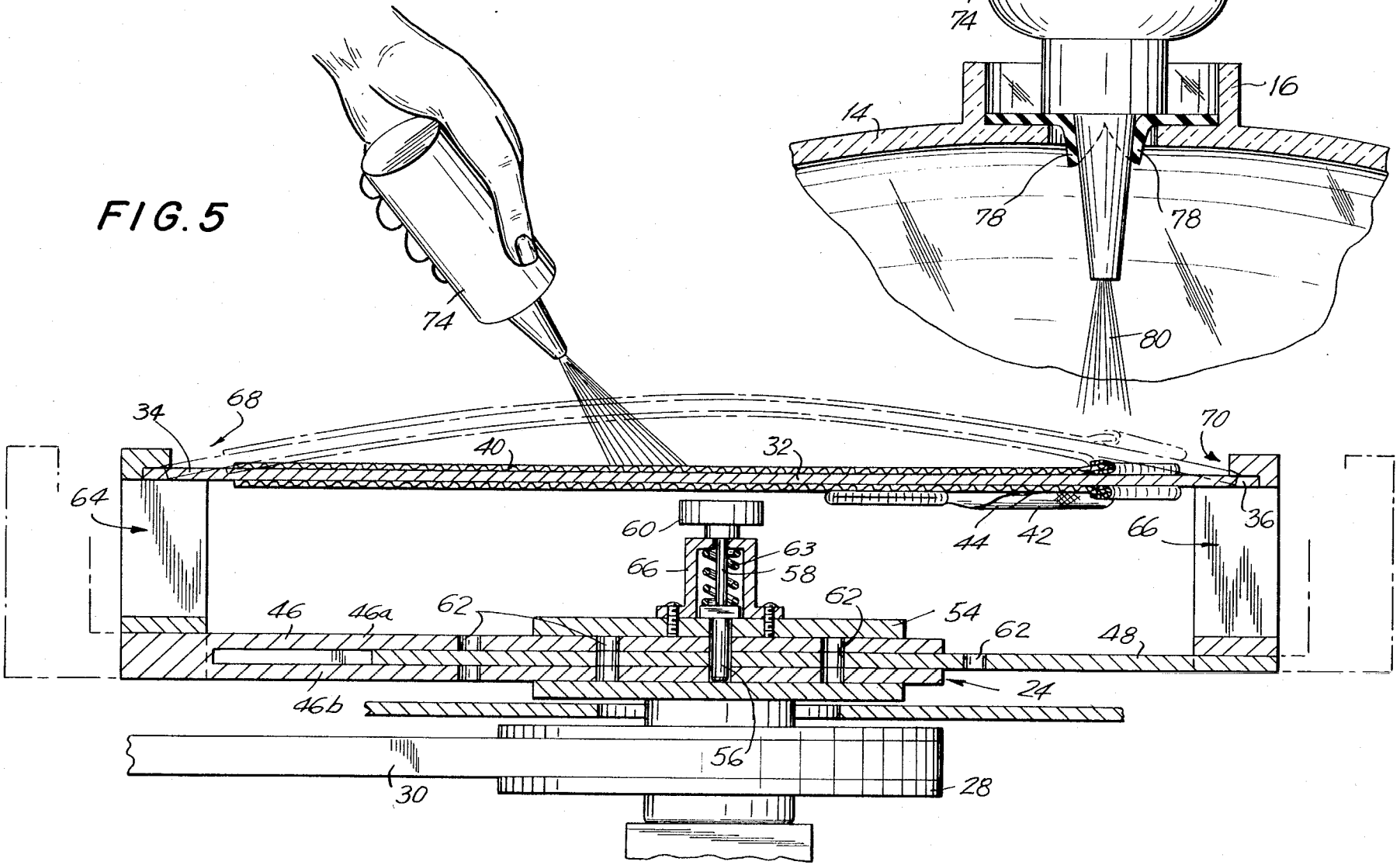
FIG. 5 is a front view taken along the line 5—5 of FIG. 3 showing paint being applied directly to a shirt while the device is in the stationary mode with the stretcher installed in the stretcher carrier.

Referring now to FIGS. 4–5, stretcher carrier means 24 is preferrably constructed so that arms 46, 48 can be adjusted to vary the distance between end blocks 50, 52, depending on the size of the stretcher means 32 to be inserted there between. Arms 46, 48 slide relative to block 54 and arm 46 is forked to allow arm 48 to slide between spaced walls 46(*a*), 46(*b*). Pin 56, connected to rod 58 and knob 60, protrudes downward through block 54 and positioning holes 62 in arms 46, 48. Spring 63 contained in pin housing 66 biases pin 56 in a downward direction. When knob 60 is manually pulled upward, pin 56 is retracted from arms 46, 48, allowing the distance between end blocks 50, 52 to be varied to another predetermined distance, depending on the location of positioning holes 62. End blocks 50, 52 are formed with vertical channels 64, 66 and horizontal slots 68, 70 respectively. Stretcher means 32 is inserted into stretcher carrier means 24 by inserting tab 34 into slot 68, flexing stretcher means 32 and then inserting tab 36 into slot 70. The orientation of stretcher means 32 in stretcher carrier means 24 is not critical, and thus, tab 34 can be inserted into slot 70 while tab 36 is inserted into slot 68.

Figure 3:
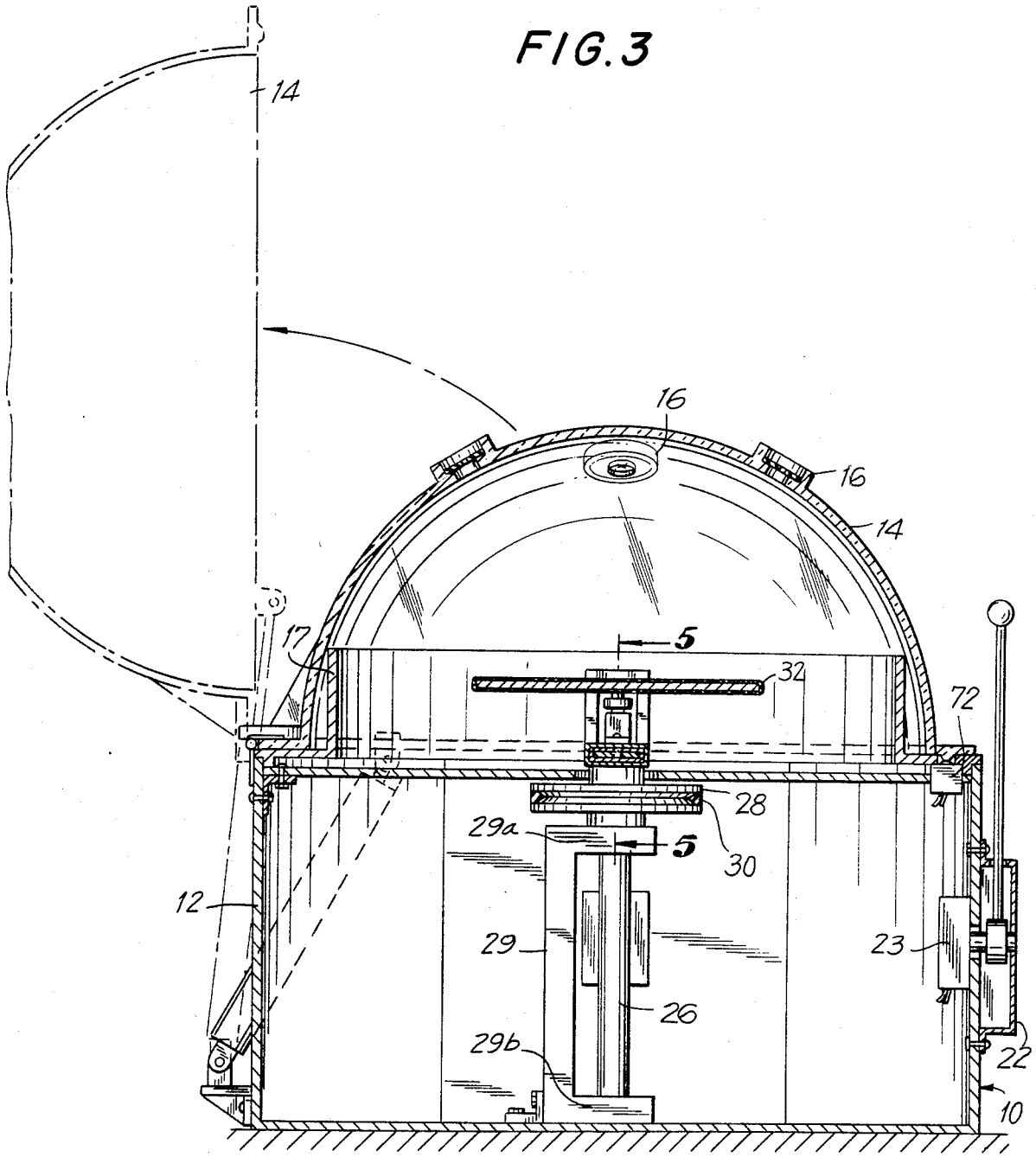
FIG. 3 is a side-sectional view of the device taken along the line 3—3 of FIG. 2 showing the mounting of the stretcher carrier and the transparent dome in both the open and closed positions.
Figure 6:
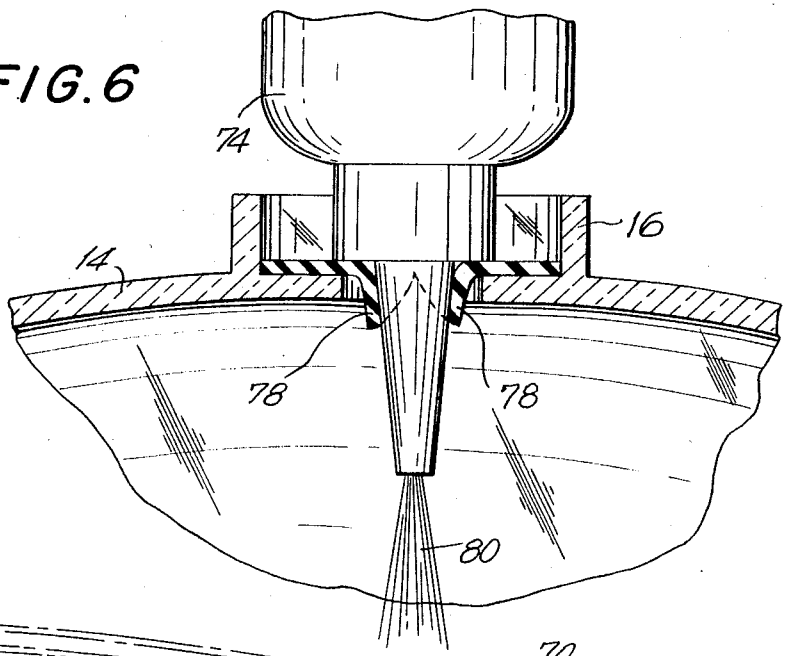
FIG. 6 is a view of a paint bottle inserted into a port in the transparent dome of the device.

Referring now to FIGS. 2–3, and 6, cover 14 is equipped with interlock switch 72 which allows motor 18 to be activated only when cover 14 is in the closed position. Cover 14 is equipped with multiple ports 16 which, as shown in FIGS. 2 and 3, are formed to hold paint bottle 74 with nose 76. Ports 16 are formed with flaps 78 that automatically close when nose 76 is removed from port 16 so that paint inadvertently thrown off of a garment will not reach the operator.

Referring now to FIGS. 2–4, during the operation of device 10, a shirt or other garment 40 is secured onto stretcher 32, as described above and inserted in stretcher carrier means 24. When cover 14 is manually closed, interlock switch 72 is closed so that motor 18 can be activated by motor control lever 22. Preferably, motor 18 rotates stretcher 32 at about 400 RPM for proper paint dispersion to occur on the clothing to be decorated. As shown in FIG. 2, decorative paint is applied to shirt 40 through ports 16 by manual manipulation of paint bottle 74. Since the flaps 78 of ports 16 (FIG. 6) are flexible, the angle of paint spray 80 can be varied, as shown in phantom in FIG. 2, depending on the desired design.

Figure 7:
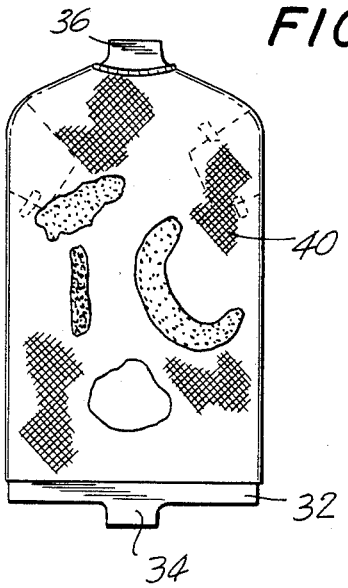
FIG. 7 is a view of decorative paint applied to a stationary shirt which is fitted on a stretcher.
Figure 8:
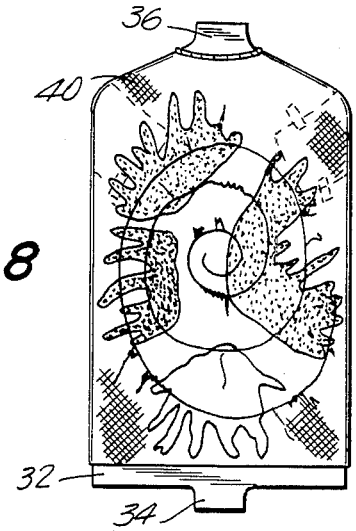
FIG. 8 is a repesentation of the design produced by the paint applied on FIG. 7 after the shirt was rotated in the device; and, FIG. 9 shows a stretcher, fitted with a shirt, installed into the drawer of a conventional drying oven.

Referring to FIGS. 5–8, it is possible to directly deposit decorative paint onto shirt 56 without doing so through one of the ports 16. Due to interlock switch 72, however, this cannot be done while shirt 40 is being rotated. FIG. 7 is a view of shirt 40 with decorative paint applied to it in a manner shown in FIG. 5. FIG. 8 shows the results of the paint application disclosed in FIG. 7 after shirt 40 has been rotated in device 10.

Figure 9:
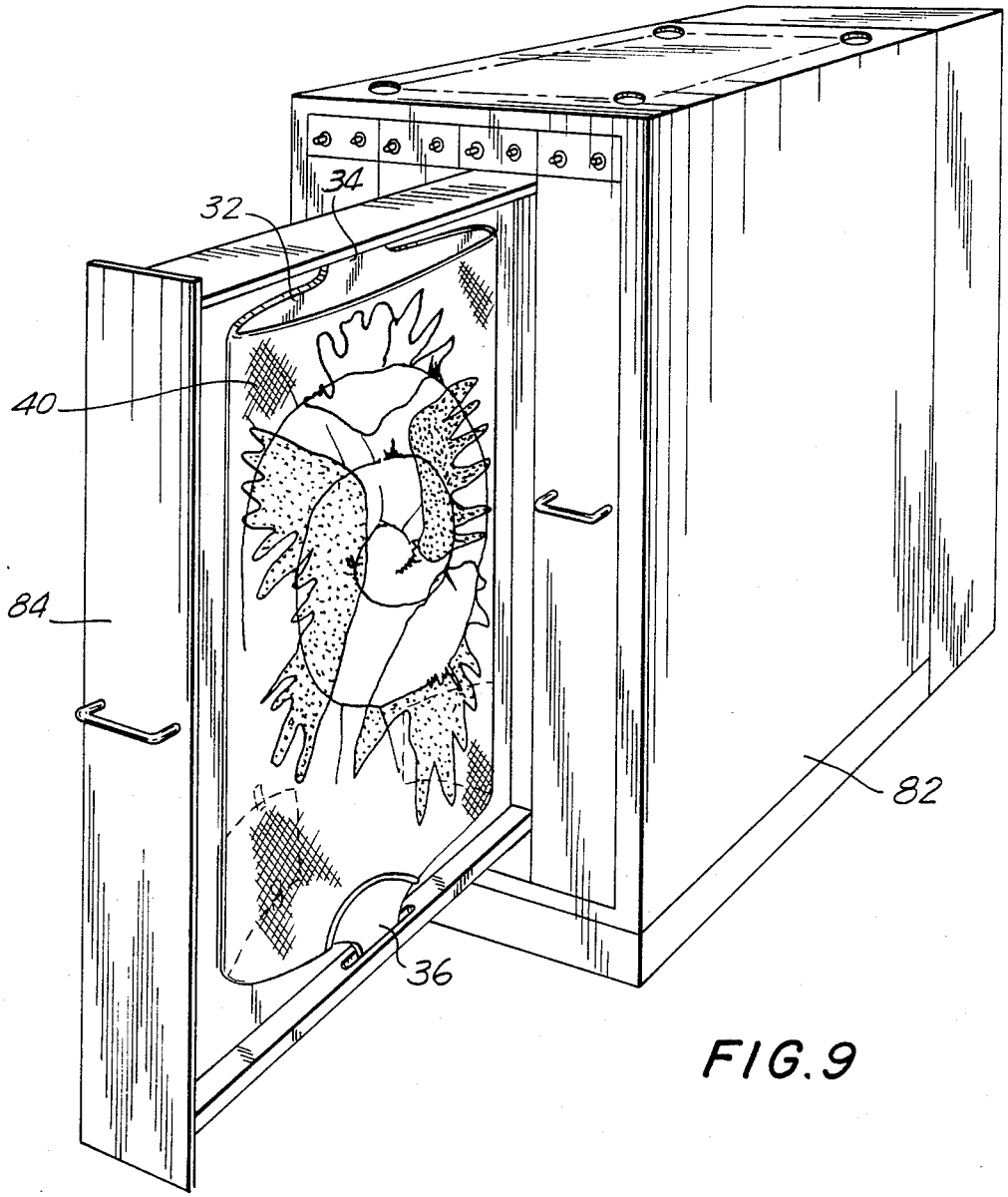

Referring now to FIG. 9, conventional drying oven 82 is shown with stretcher means 32 installed in drawer 84 for rapid drying of the decorative paint on shirt 40. Shirt 40 remains on stretcher means 32 throughout the entire production process, including the drying stage, so that the possibility of either bleed through of the paint or smearing of the paint through handling of the shirt is eliminated.

While that has been described is the presently preferred embodiment of the invention, it will be apparent to those skilled in the art that modifications and changes can be made to the invention while keeping within the spirit and scope thereof which is set forth in the appended claims.

I claim:

1. A device for producing decorative patterns on clothing comprising a housing, a motor mounted to said housing, stretcher carrier means operatively engaged with said motor, said stretcher carrier means including a first support arm, a second support arm, a first end block mounted proximate to the end of said first support arm, a second end block mounted proximate to the end of said second support arm, means for adjustably supporting said first arm support relative to said second arm support to permit the distance between said first and second end blocks to be varied, a plurality of stretcher means releaseably engaged with said first and second end blocks of said stretcher carrier means, said stretcher means being formed of different sizes to support various sized articles of clothing while the decorative patterns are produced on the clothing, cover means mounted to said housing, said cover means including at least one port, pliable flap means mounted to said port providing a closeable access to the interior of said device to receive the nozzle portion of a container of decorative paint to permit the application of decorative paint to the interior of said device and allow the decorative paint to be applied to the clothing to be decorated from various angles, and activation means electrically engaged with said motor and adapted to cause said stretcher carrier means to rotate within said housing while said paint is applied to said clothing to permit decorative patterns to be created on clothing.

2. A device for producing decorative patterns on clothing comprising a housing, a motor mounted to said housing, stretcher carrier means operatively engaged with said motor and adapted to be rotated thereby within said housing, said stretcher carrier means including a first support arm, a second support arm, a first end block mounted proximate to the end of said first support arm, a second end block mounted proximate to the end of said second support arm, means for adjustably supporting said first support arm relative to said second support arm to permit the distance between said first and second end blocks to be varied, a plurality of stretcher means adapted to be inserted between the first and second end blocks of said stretcher carrier means formed of various sizes to permit clothes of various sizes to be supported so that the front of said clothing is separated from the rear of said clothing to prevent bleed through of paint during the decoration process, cover means mounted to said housing and formed with at least one self-closing port to confine decorative paint to the interior of said device, said self-closing port on said cover including pliable flap means closing the port to the area outside the interior of said device when said port is not in use, said pliable flaps on said self-closing port providing access to the interior of said device to receive the nozzle portion of a container of decorative paint to permit the application of decorative paint to the interior of said device and allow the decorative paint to be applied to the supported clothing from various angles, and activation means connected to said motor and adapted to cause said stretcher carrier means to rotate at variable speeds within said housing while said paint is applied to said clothing to permit decorative patterns to be created on clothing.

* * * * *